US007191510B1

(12) United States Patent
Sanderson et al.

(10) Patent No.: US 7,191,510 B1
(45) Date of Patent: Mar. 20, 2007

(54) ELECTROLUMINESCENT (EL) LAMP WITH CURRENT LIMITING FUSE

(76) Inventors: Stephen Jay Sanderson, 83 Heffner Rd., Royersford, PA (US) 19468; Stephen Ray Stiles, 212 S. Showhorse, Liberty Hill, TX (US) 78642

( * ) Notice: Subject to any disclaimer, the term of this patent is extended or adjusted under 35 U.S.C. 154(b) by 112 days.

(21) Appl. No.: 10/727,098

(22) Filed: Dec. 3, 2003

(51) Int. Cl.
*H01H 69/02* (2006.01)
*G08B 21/00* (2006.01)

(52) U.S. Cl. ..... 29/623; 315/74; 313/485; 340/638

(58) Field of Classification Search ..... 315/72, 315/73, 74; 313/491, 498, 506, 580, 485; 337/4; 257/209; 340/638; 29/623
See application file for complete search history.

(56) References Cited

U.S. PATENT DOCUMENTS 4,458,177 A * 7/1984 Hunter et al. ..... 313/511
4,851,734 A * 7/1989 Hamai et al. ..... 313/485
5,530,318 A * 6/1996 Ensign et al. ..... 315/74
5,563,472 A * 10/1996 Cassidy ..... 315/119
5,976,613 A * 11/1999 Janusauskas ..... 427/66
6,838,971 B2 * 1/2005 Senda et al. ..... 337/296
2002/0101164 A1 * 8/2002 Yan ..... 315/58
2003/0168967 A1 * 9/2003 Ikeda ..... 313/498

OTHER PUBLICATIONS

Swati et al, ITO, Tin-Doped Indium Oxide for Optical coating, http://www.cerac.com/pubs/proddata/ito.htm, p. 2.*
Jabbour et al, Screen Printing for the Fabrication of Organic Light-Emitting Devices, 2001, IEEE, p. 1.*
PET (polyethylene terephthalate), Torben Lenau, 1996-2003, p. 1.*
LITTELFUSE, INC., "AC Line Voltage Transients and Their Suppression," Apr. 2002, pp. 1-4, U.S.
Carpenter, Jr., Roy B. et al., "Protection From Incoming Power Line Voltage Anomalies," pp. 1-31, Lightning Eliminators & Consultants, Ins., Revised May 1997, U.S.

* cited by examiner

*Primary Examiner*—Don Wong
*Assistant Examiner*—Angela M Lie
(74) *Attorney, Agent, or Firm*—Wong, Cabello, Lutsch, Rutherford & Brucculeri, LLP

(57) ABSTRACT

An electroluminescent (EL) lamp having at least two integral fusible links and a method of manufacturing such a lamp are disclosed. The present invention provides for a fusible link between the front electrode input power contact area and the transparent electrode. In addition, the present invention provides a second fusible link between the back electrode input power contact area and the transparent electrode. The fusible links are designed to become non-conductive (open) if a certain current level is exceeded. The EL lamp fails in a controlled way, without signs of combustion. The EL lamp is therefore protected from self-destruction when subject to an anomaly or manufacturing defect.

22 Claims, 2 Drawing Sheets

ELECTROLUMINESCENT (EL) LAMP WITH CURRENT LIMITING FUSE

FIELD OF THE INVENTION

The present invention relates generally to electroluminescent (EL) lamps, and more particularly, to an improved electroluminescent lamp having at least two fusible links.

BACKGROUND OF THE INVENTION

EL lamps are typically formed by depositing a number of layers onto a transparent substrate. The layers typically include the transparent substrate, a transparent front electrode, a phosphor layer, two or more dielectric layers, and a rear electrode. Various other layers are often included. When an alternating electric current is applied to the two electrodes, a field is developed, and the phosphor layer emits light. One example of an EL lamp is a night light.

EL lamps powered directly from the AC line, such as standard 120 vrms/60 Hz house power, are susceptible to voltage surges that could breakdown the dielectric insulator used to separate the front and back electrodes of the EL lamp. Surges, also referred to as anomalies, are short duration high voltage spikes that can randomly occur on the AC line. These surges can come from lightning, the local utility, neighbors, and machines sharing the power source. An anomaly may cause EL lamps to fail catastrophically resulting in a slow sustained combustion. The surges can also cause an arc to jump between the front and back electrode conductors, especially if the gap between the electrodes is made smaller because of a manufacturing defect. Defects introduced during the manufacturing process, i.e., ink bleeds that can either electrically short the front and back electrodes or reduce the designed gap between the two electrodes, can cause an EL lamp to fail similarly. A byproduct of the combustion is carbon. The combustion is fed by the high current available from the power source and will continue until current no longer can flow.

The dielectric breakdown or arc could initiate combustion of the EL materials, resulting in the heating up of the EL lamp enclosure leading to the destruction of the device and possible damage to adjacent objects. The combustion is fed by the high current available from the power source and will continue until there is not sufficient current to sustain the heat required to maintain combustion. Since the product of the combustion is carbon, and carbon is conductive, once initiated, the EL lamp can self-destruct. The catastrophic failure has the potential to do physical damage to a dwelling or other premises in which an EL lamp device is installed.

SUMMARY OF THE INVENTION

One approach is to use an external fuse sized to fail before the EL lamp can be destroyed. An external fuse is not desirable, however, because the failure current needs to be much lower than the known commercial fuses available. Furthermore, the added costs would make the price point too high for the majority of the market.

Another solution is to add resistance in series with the EL lamp to limit the current available to drive the EL lamp; however, there are two drawbacks to this solution: (1) the cost of the resistor(s) and the interconnect method between the AC power source and EL lamp; and (2) the increased area needed to accommodate the resistor(s).

A need has therefore arisen to provide an EL lamp that overcomes the limitations of the prior art. The present invention discloses a method and apparatus to protect an EL lamp from catastrophic destruction initiated by the power source for the EL lamp. The disclosed EL lamp has an equivalent load that is mainly capacitive, two electrodes with a dielectric separation.

The present invention takes advantage of high current spikes induced by the anomaly by using a fusible link, designed to fail in a safe way, i.e., with no sustained combustion. One fusible link is located between the front electrode input contact and the front electrode of the EL lamp, and another fusible link is located between the back electrode input contact and the back electrode of the EL lamp. There are two fusible links due to the potential for the front electrode input power contact to short to the back, or the back electrode input contact to short to the front. The fusible link fails quickly and with no byproduct, i.e., blackening, of the EL lamp or EL lamp enclosure.

Besides the fusible link, the conductive material used for the front and back electrode input contact interface to the transparent front electrode was found to contribute to the undesired failure mode. If a highly conductive material is used, the failure mode was unpredictable. The low resistance interface between the AC input and the transparent front electrode could cause the transparent electrode to fracture along that interface instead of the fusible link failing, when subject to an anomaly. When failing in this mode, there can be blacking of the EL lamp and/or EL lamp enclosure. If a high resistance conductive material is used, the failure mode is more predictable and the failure mode is as desired. A high resistance material can be used because the typical operating current of a night light power at 120 vrms/60 Hz is 0.5 ma; therefore the resistance would have to be greater than 10,000 ohms to have any noticeable effect on the EL lamp performance. The effect would only be low luminance level, having no effect on the safety of the EL lamp.

In accordance with the present invention, the EL lamp is protected from self-destruction when subject to an anomaly or manufacturing defect. The lamp fails in a controlled way. The protection is in the form of a fusible link between the power source and the front and/or back electrodes of the EL lamp. Furthermore, the EL lamp fails without signs of combustion. In addition, the protection is an integral part of the EL lamp, rather than external to the EL lamp. The protection provided by the present invention is easily adjustable so it can be used for all EL lamp sizes. In addition, the fusible link can be made using materials that are typically already used in EL lamp manufacturing. By implementing the present invention, a failure would look like a non-operating product to the consumer, eliminating the concerns for safety and potential damage to a consumer's dwelling.

BRIEF DESCRIPTION OF THE DRAWINGS

The following drawings form part of the present specification and are included to further demonstrate certain aspects of the present invention. The invention may be better understood by reference to one or more of these drawings in combination with the detailed description of specific embodiments presented herein.

DETAILED DESCRIPTION OF THE INVENTION

Figure 1:
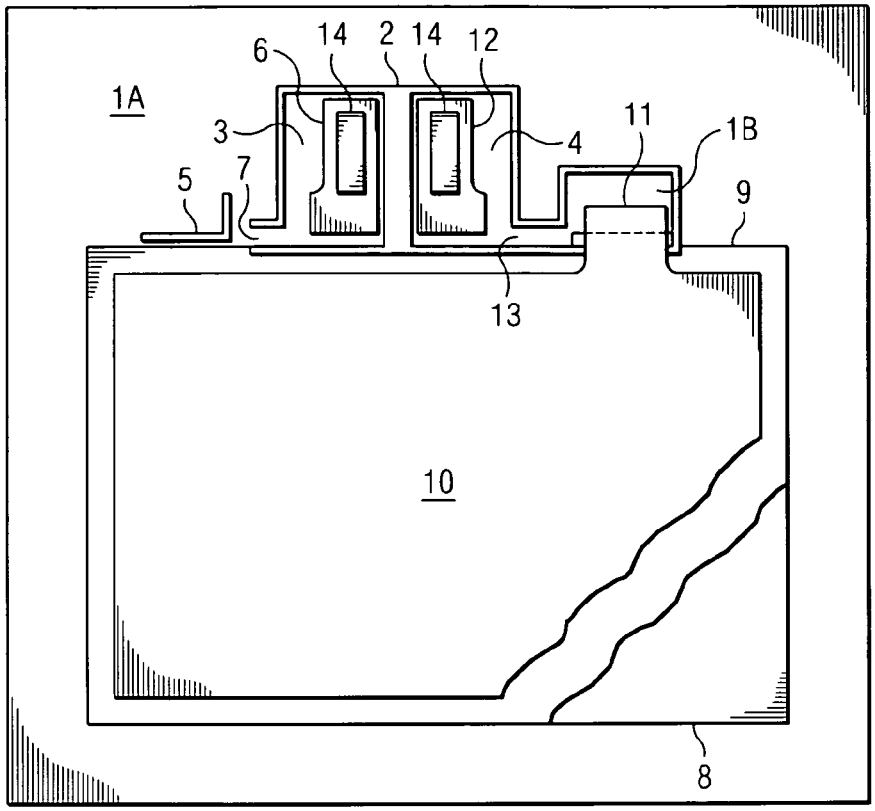
FIG. 1 depicts a plan view of an EL lamp in accordance with one embodiment of the present invention.
Figure 2:
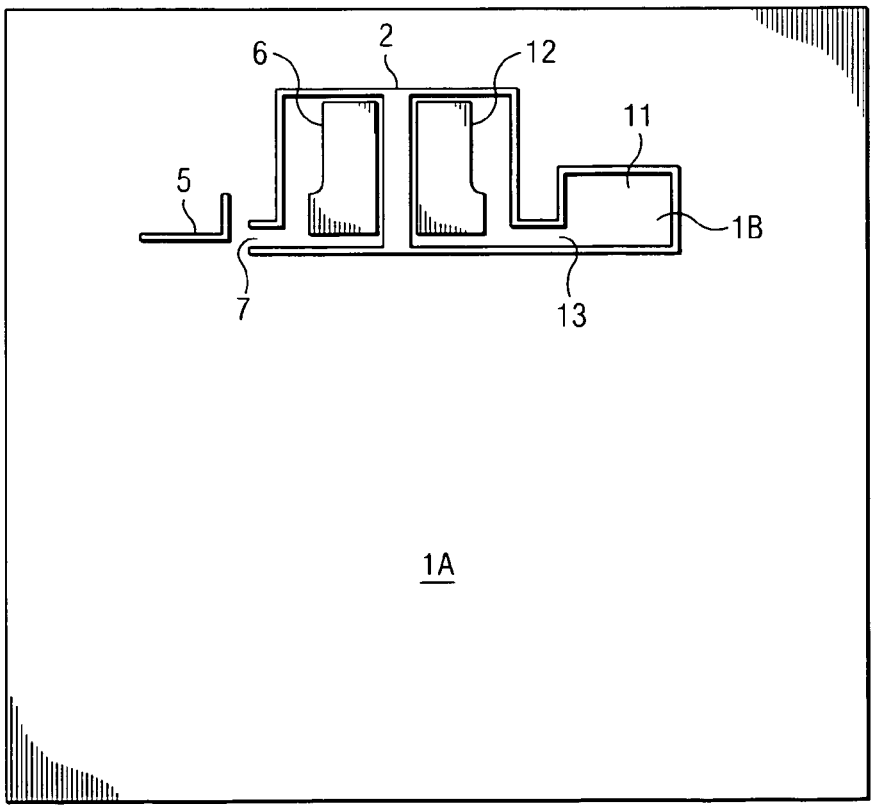
FIG. 2 depicts a plan view of the fusible links and the front electrode conductive ink layer of an EL lamp in accordance with one embodiment of the present invention.
Figure 3:
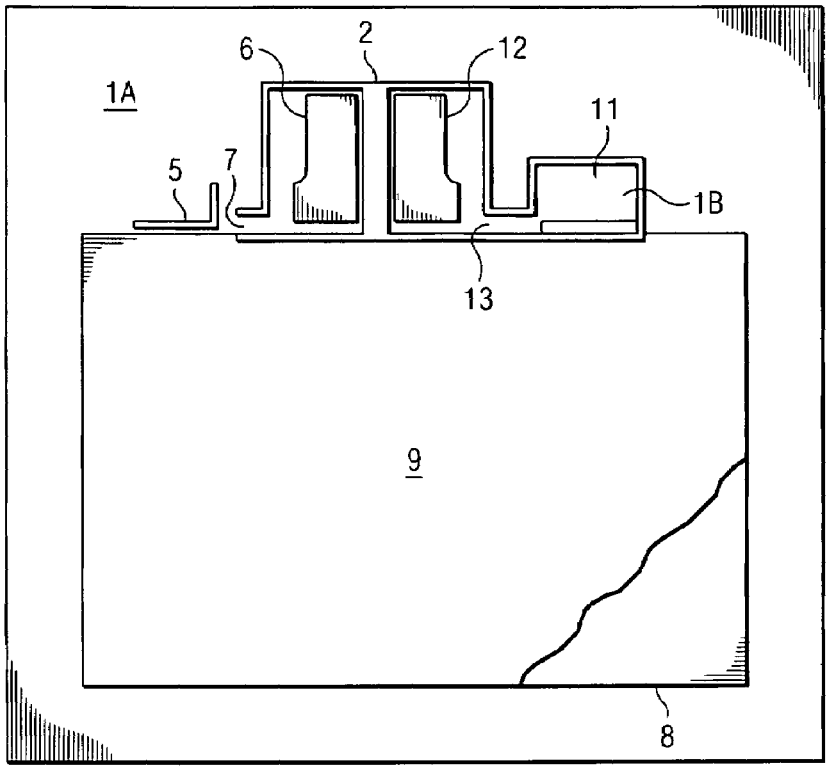
FIG. 3 depicts a plan view of the added phosphor layer and dielectric layers in an EL lamp in accordance with one embodiment of the present invention.
Figure 4:
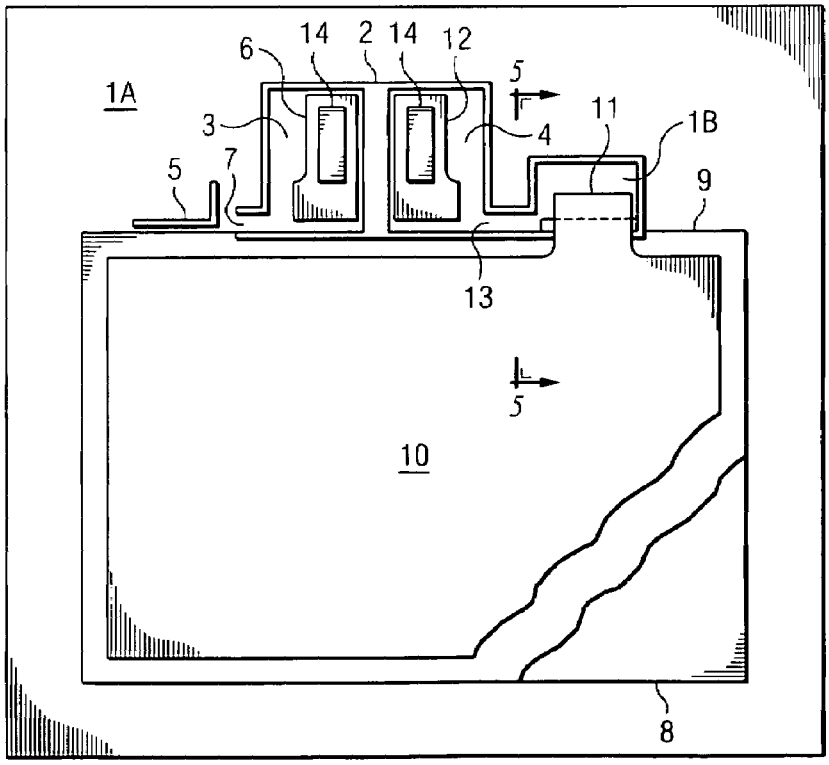
FIG. 4 depicts a plan view of the added back electrode and highly conductive pad in an EL lamp in accordance with one embodiment of the present invention.
Figure 5:
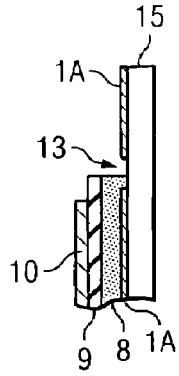
FIG. 5 depicts a sectional view taken along line 5—5 of FIG. 4.

In one embodiment, blanket deposition of the ITO onto the substrate 15 is followed by selective removal of the ITO according to a desired pattern by means of lasing, chemical etching, abrasive scribing, or other suitable means. Thus, a portion of the front electrode conductor 1 may be removed 2, leaving two sections or islands 3 and 4 of the front conductor with a gap 7 and a gap 13 of a certain width to conduct current from inside the islands to outside for powering the front and back electrodes of the EL lamp 101. In another embodiment, ITO is selectively deposited onto the substrate 15, such as by painting or screen-printing or other suitable means, only in desired areas to form a desired pattern. This provides a cost-saving benefit by conserving resources, and avoiding unnecessary waste of ITO that would otherwise be removed.

The front electrode input power contact area 6 and the back electrode input power contact area 12 may be printed on the conductive substrate within the two islands 3 and 4, respectively. These printed areas are not required to conduct current from the electrical contact areas to the EL lamp front electrode 1 and back electrode 10. Gap 7 allows current to flow from the front electrode power contact 6 and the front electrode bus bar 5. Gap 13 allows current to flow from the back electrode power contact 12 to back electrode isolated area 1B.

In accordance with the present invention, the gaps 7 and 13 serve as fusible links, i.e., conductors of electrical current which connect, or link, an input power connection point to the electrical device input power. More particularly, fusible link 7 provides a link between the front electrode input power contact area 6 and the conductive ITO 1A, while fusible link 13 provides a link between the back electrode input power contact area 12 and the conductive ITO 1B. The fusible links 7 and 13 are designed to become non-conductive (open) if a certain current level is exceeded. The fusible links 7 and 13 are used to protect an electrically powered device from self-destructing if the device fails in a mode that causes high current to flow.

The fusible link 7 is designed to fail in a non-conductive state (i.e., become an open circuit) if there is a low resistance path created between the front electrode input power contact 6, front electrode 1 or bus 5 and EL lamp back electrode 10 or power contact 12. In accordance with the present invention, fusible link 13 is designed to fail if the there is a low resistance path between the front electrode power contact 6 and back electrode 10. This protection is desirable because of the small gap between the power contact and the back electrode of the EL lamp which can be jumped or arced across due to a power line anomaly. Such an arc can cause a low resistance path between the power contacts, which has the potential to heat and cause combustion.

The fusible links 7 and 13 shown in FIG. 1 depict one possible design. It will be appreciated by those of skill in the art that the shape, pattern, and configuration of the fusible links 7 and 13 can be varied while still achieving the desired result.

The next step will depend on the lamp design. In one embodiment, a carbon-filled conductive composition 14 may be deposited onto the transparent electrode. In another embodiment, the carbon-filled conductive composition 14 is deposited onto the transparent electrode at the same time a second electrode 10 is deposited.

The front electrode bus 5 is separated from the front electrode input power contact 6 by the fusible link 7. A phosphor layer 8 is deposited onto the transparent electrode 1. A dielectric layer 9 is deposited onto the phosphor layer 8. A second electrode 10 is deposited onto the dielectric layer 9 with an extended area 11 deposited onto the transparent front electrode isolated from the EL lamp transparent front electrode 1 by the ITO patterning process. The result is that the second electrode 10 is separated from the back electrode input power contact 12 by a second fusible link 13. A high conductivity composition 14 is deposited onto the front electrode layer to aid the connection between the AC input power contacts and the EL lamp.

The present invention therefore provides an EL lamp, such as a night light, that is protected from self-destruction when subject to an anomaly or manufacturing defect. The lamp of the present invention fails in a controlled way. Furthermore, the EL lamp fails without signs of combustion. The protection is in the form of two fusible links between the power source and the front and/or back electrodes of the EL lamp. In addition, the protection is an integral part of the EL lamp, rather than external to the EL lamp. The protection provided by the present invention is easily adjustable so it can be used for all EL lamp sizes. In addition, the fusible link can be made using materials that are typically already used in EL lamp manufacturing. By implementing the present invention, a failure would look like a non-operating product to the consumer, eliminating the concerns for safety and potential damage to a consumer's dwelling.

Further modifications and alternative embodiments of this invention will be apparent to those skilled in the art in view of this description. Accordingly, this description is to be construed as illustrative only and is for the purpose of teaching those skilled in the art the manner of carrying out the invention. It is to be understood that the forms of the invention herein shown and described are to be taken as exemplary embodiments. Various changes may be made in the shape, size, and arrangement of parts. For example, equivalent elements or materials may be substitute for those illustrated and described herein, and certain features of the invention may be utilized independently of the use of other features, all as would be apparent to one skilled in the art after having the benefit of this description of the invention.

What is claimed is:

1. An electroluminescent lamp comprising:

a first section of transparent, electrically conductive material selectively patterned on a surface of a substrate;

a second section of transparent, electrically conductive material selectively patterned on the surface of the substrate, wherein the second section of transparent, electrically conductive material is electrically isolated from the first section of transparent, electrically conductive material;

a carbon-filled conductive composition deposited onto the transparent, electrically conductive material;

a first integral fusible link between a first electrode input tower contact and the first section of transparent, electrically conductive material; and a second integral fusible link between a second electrode input power contact and the second section of transparent, electrically conductive material;

wherein the first fusible link or the second fusible link fails to allow electrical current to flow if a certain level of current is exceeded.

2. The electroluminescent lamp as claimed in claim 1, further comprising a phosphor layer deposited onto the transparent, electrically conductive material.

3. The electroluminescent lamp as claimed in claim 2, further comprising a dielectric layer deposited onto the phosphor layer.

4. The electroluminescent lamp as claimed in claim 1, wherein the transparent conductive material comprises indium tin oxide.

5. The electroluminescent lamp as claimed in claim 1, wherein the substrate comprises polyethylene terephthalate.

6. An electroluminescent lamp comprising:

a first section of indium tin oxide selectively patterned on a surface of a substrate;

a second section of indium tin oxide selectively patterned on the surface of the substrate, wherein the second section of indium tin oxide is electrically isolated from the first section of indium tin oxide;

a carbon-filled conductive composition deposited onto the indium tin oxide;

a phosphor layer deposited onto the indium tin oxide;

a dielectric layer deposited onto the phosphor layer;

a first electrode input power contact;

a second electrode input power contact;

a first integral fusible link between the first electrode input power contact and the first section of indium tin oxide; and a second integral fusible link between the second electrode input power contact and the second section of indium tin oxide;

wherein the first fusible link or the second fusible link fails to allow electrical current to flow if a certain level of current is exceeded, without exhibiting signs of combustion.

7. The electroluminescent lamp as claimed in claim 6, wherein the electroluminescent lamp comprises a night light.

8. The electroluminescent lamp as claimed in claim 6, wherein the substrate comprises polyethylene terephthalate.

9. A method for manufacturing an electroluminescent lamp, the method comprising the acts of:

depositing a transparent, electrically conductive material onto a surface of a substrate to form a pattern comprising a first section of transparent, electrically conductive material and a second section of transparent, electrically conductive material;

providing a first integral fusible link between a first electrode input power contact and the first section of transparent, electrically conductive material; and providing a second integral fusible link between a second electrode input power contact and the second section of transparent, electrically conductive material;

wherein the first fusible link or the second fusible link fails to allow electrical current to flow if a certain level of current is exceeded;

wherein the act of depositing a transparent, electrically conductive material onto a surface of a substrate comprises the act of removing a portion of the transparent, electrically conductive material.

10. The method as claimed in claim 9, wherein the act of removing a portion of the transparent, electrically conductive material comprises lasing.

11. The method as claimed in claim 9, wherein the act of removing a portion of the transparent, electrically conductive material comprises chemical etching.

12. The method as claimed in claim 9, wherein the act of removing a portion of the transparent, electrically conductive material comprises scribing.

13. The method as claimed in claim 9, wherein the transparent conductive material comprises indium tin oxide.

14. The method as claimed in claim 9, wherein the substrate comprises polyethylene terephthalate.

15. The method as claimed in claim 9, further comprising the act of depositing a phosphor layer onto the transparent, electrically conductive material.

16. The method as claimed in claim 15, further comprising the act of depositing a dielectric layer onto the phosphor layer.

17. A method for manufacturing an electroluminescent lamp, the method comprising the acts of:

depositing a transparent, electrically conductive material onto a surface of a substrate to form a pattern comprising a first section of transparent, electrically conductive material and a second section of transparent, electrically conductive material;

depositing a carbon-filled conductive composition onto the transparent, electrically conductive material;

providing a first integral fusible link between a first electrode input power contact and the first section of transparent, electrically conductive material; and providing a second integral fusible link between a second electrode input power contact and the second section of transparent, electrically conductive material;

wherein the first fusible link or the second fusible link fails to allow electrical current to flow if a certain level of current is exceeded.

18. The method as claimed in claim 17, further comprising the act of depositing a phosphor layer onto the transparent, electrically conductive material.

19. The method as claimed in claim 18, further comprising the act of depositing a dielectric layer onto the phosphor layer.

20. The method as claimed in claim 17, wherein the transparent conductive material comprises indium tin oxide.

21. The method as claimed in claim 17, wherein the substrate comprises polyethylene terephthalate.

22. The method as claimed in claim 17, wherein the act of depositing a transparent, electrically conductive material comprises screen printing the transparent, electrically conductive material onto selected portions of the substrate.

* * * * *